US005320441A

United States Patent [19]

Yamakawa

[11] Patent Number: 5,320,441

[45] Date of Patent: Jun. 14, 1994

[54] WIRE-DOT PRINTER IN WHICH PRINTING MODES CAN BE CHANGED OVER FROM ONE TO ANOTHER

[75] Inventor: Yuichi Yamakawa, Tokyo, Japan

[73] Assignee: Seikosha Co., Ltd., Tokyo, Japan

[21] Appl. No.: 975,044

[22] Filed: Nov. 12, 1992

[30] Foreign Application Priority Data

Nov. 15, 1991 [JP] Japan ..... 3-300583

[51] Int. Cl.[5] ..... B41J 2/265

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,010,835 | 3/1977 | Martin et al. . | |
| 4,031,992 | 6/1977 | Murat et al. | 400/124 |
| 4,470,713 | 9/1984 | Rossopoulos | 400/124 |
| 4,470,713 | 9/1984 | Rossopoulos . | |
| 4,475,826 | 10/1984 | Durr et al. | 400/124 |
| 4,605,323 | 8/1986 | Blanchard et al. . | |

FOREIGN PATENT DOCUMENTS

| | | | |
|---|---|---|---|
| 0027734 | 4/1981 | European Pat. Off. | 400/124 |
| 0040883 | 12/1981 | European Pat. Off. | 400/124 |
| 3019515 | 11/1981 | Fed. Rep. of Germany | 400/124 |
| 3208104 | 9/1983 | Fed. Rep. of Germany . | |
| 63-99960 | 2/1988 | Japan . | |

*Primary Examiner*—Edgar S. Burr
*Assistant Examiner*—John S. Hilten
*Attorney, Agent, or Firm*—Jordan and Hamburg

[57] ABSTRACT

Printing wires are able to be changed over from one to another by the movement of a printing head alone, thereby eliminating the need for a solenoid and simplifying the arrangement. The printing quality is improved by uniformly guiding the printing wires with the entire circumference of each guide hole, and further the amount of torsion of the printing wires caused by changeover of the printing wire arrangements is equalized, thereby stabilizing the printing characteristics and eliminating the difference in the printing characteristics between the parallel and staggered arrangements and also improving the durability. A first front guide is secured to a nose portion of a head frame. A front guide supporting frame, which supports a second front guide, is provided on the nose portion of the head frame so that the frame is movable in the direction of alignment of the printing wires. The printing wires are guided by the second front guide and the first front guide. The head frame is provided with a sliding member and a transmission-changeover means which causes the front guide supporting frame to be displaced in response to displacement of the sliding member. When the printing head is moved beyond the normal travel region, the sliding member abuts against a stationary member in the printer and is thereby displaced. The transmission-changeover means causes the front guide supporting frame to be displaced in response to the displacement of the sliding member, thereby moving the second front guide, and thus changing over the staggered and parallel arrangements from one to the other.

29 Claims, 15 Drawing Sheets

WIRE-DOT PRINTER IN WHICH PRINTING MODES CAN BE CHANGED OVER FROM ONE TO ANOTHER

FIELD OF THE INVENTION

The present invention relates to a wire-dot printer in which printing modes can be changed over from one to another.

BACKGROUND OF THE INVENTION

There has heretofore been a printing head in which a plurality of printing wires are electromagnetically driven to form a dot-matrix record on a recording medium which is on a platen, through an ink ribbon with the front ends of the printing wires. Recently, with the demand for a higher printing density, the number of printing wires has increased. For example, there is a printing head having 24 printing wires which are aligned in two rows in a direction substantially perpendicular to the direction of movement of the printing head. The front end portion of each printing wire extends through a predetermined guide hole in a front guide.

There are two different arrangements of printing wires. One is a parallel arrangement in which two wires which are adjacent to each other in the direction of movement of the printing head are at the same level. The other is a staggered arrangement in which two wires which are adjacent to each other in the direction of movement of the printing head are offset from each other by a half-pitch. The parallel arrangement is suitable for high-speed printing (draft mode), while the staggered arrangement is suitable for high-density printing (NLQ (Near Letter Quality) mode).

In the prior art, some arrangements which enable the parallel and staggered arrangements to be changed over from one to the other as desired have been disclosed.

Firstly, U.S. Pat. No. 4,010,835 (Japanese Patent Application Post-Examination Publication No. 57-60950) discloses an arrangement as a specific means for attaining the above-described purpose, in which a wire guide that supports one row of printing wires is arranged to be fixed, while another wire guide that supports another row of printing wires is arranged to be movable vertically by a solenoid, and the two guides are disposed adjacent to each other. When the movable wire guide is moved upwardly, a staggered arrangement is formed, whereas, when it is moved downwardly, a parallel arrangement is formed. As another specific means, a single wire guide is arranged to support all printing wires and to be rotatable by a small amount either clockwise or counterclockwise. When the printing wires are aligned in left-downwardly inclined form by clockwise rotation, a parallel or staggered arrangement is obtained. When the printing wires are aligned in right-downwardly inclined form by counterclockwise rotation, the other arrangement is obtained.

Secondly, U.S. Pat. No. 4,470,713 (Japanese Patent Application Post-Examination Publication No. 2-29022) discloses an arrangement in which a front guide is formed of three plates which are adjacent to each other, and two adjacent plates of the three are used as fixed guide plates, while the other plate is used as a movable guide plate. Guide holes are provided as follows: In the fixed guide plates, semicircular recesses are formed in the opposing end faces in opposing relation to each other, and one row of printing wires on the fixed side are supported by the recesses. Another row of printing wires are supported by recesses provided in the opposing end faces of the fixed and movable guide plates.

More specifically, semicircular recesses are formed in the end face of the movable guide plate, and the printing wires of the second row are disposed in the recesses, while the end face of the fixed guide plate has small irregularities on the respective bottoms of the recesses so that the printing wires of the second row are allowed to shift by a half-pitch. Further, in order to limit the stroke of the movable guide plate, semicircular recesses are provided in the movable guide plate at the upper and lower sides of the row of printing wires, and shafts each having the same diameter as those of the printing wires are secured in the recesses. The fixed guide plate is formed with recesses at positions which face the shafts, respectively. Each of the recesses comprises two circular arcs having the same curvature radius as that of the holes receiving the printing wires. The center distance of the two circular arcs is half the center distance of each pair of adjacent holes receiving printing wires. Each shaft selectively fits into either of the two circular arcs. Thus, the shaft can move vertically by a half-pitch. The movable guide plate is secured to a support member, which is biased toward the fixed guide plates by a spring force. Further, the support member is provided with a finger-shaped member. Left and right side plates which the printing head faces when moved leftwardly and rightwardly, respectively, are provided with upwardly and downwardly inclined surfaces, respectively. Accordingly, when the finger-shaped member engages with the upwardly inclined surface, the movable guide plate moves upwardly, so that the printing wires are arranged in the staggered pattern, whereas, when the finger-shaped member engages with the downwardly inclined surface, the movable guide plate moves downwardly, so that the printing wires are arranged in the parallel pattern.

Thirdly, U.S. Pat. No. 4,605,323 discloses an arrangement in which two rows of printing wires are supported by respective guides which are movable vertically independently of each other. The two guides are mounted on a plate which is moved forwardly and backwardly by a solenoid. The upper side of this plate is formed with two inclined surfaces where the two guides are mounted, respectively. The two inclined surfaces are opposite to each other in the direction of inclination. Accordingly, when the plate moves forwardly, one guide moves upwardly, while the other guide moves downwardly, whereas, when the plate moves backwardly, the first guide moves downwardly, while the second guide moves upwardly. Thus, the relative positions of the two rows of printing wires are changed over from those for a staggered arrangement to those for a parallel arrangement, or vice versa.

Fourthly, German Patent Application Laid-Open No. 3,208,104 discloses an arrangement in which a rotatable front guide is rotated a little either clockwise or counterclockwise, thereby changing over the arrangement of printing wires to a parallel arrangement in which the printing wires align in a left-downwardly inclined form or a staggered arrangement in which the printing wires align vertically. A mechanism that is actually used to rotate the front guide is described below.

That is, a sliding bar is connected to the front guide, and a solenoid is disposed at the outside of a base plate of the printer. The arrangement is such that when the carrier stops in close proximity to the base plate, the sliding bar projects from the base plate. Then, the solenoid is driven to project the plunger so as to engage with the sliding bar. At this time, when the printing head is moved a little toward or away from the base plate, the front guide rotates a little clockwise or counterclockwise through the sliding bar, thereby allowing the parallel and staggered arrangements to be changed over from one to the other.

Fifthly, Japanese Patent Application Laid-Open (KOKAI) No. 63-99960 discloses an arrangement in which guide hole arrangements of two front guides are partly or wholly displaced from each other to thereby incline the corresponding wires. In addition, the gap between the head and the platen is changed to thereby change the position where dots are formed by the front ends of the wires to a position corresponding to the parallel arrangement or the staggered arrangement, thereby allowing the high-speed and high-density printing modes to be changed over from one to the other.

The above-described first prior art requires a solenoid for vertically driving one wire guide and therefore provides an increase in the cost. In the arrangement where the front guide is rotated, since the arrangement of the printing wires is not perpendicular to the direction of movement of the printing head, whether in the parallel arrangement or the staggered arrangement, the processing of printing data for driving the wires becomes complicated, so that the required memory capacity increases, and the processing speed must be increased. Thus, the cost of the control circuit rises. In addition, printing wires which are close to the center of rotation of the front guide and those which are remote from it have different amounts of torsion applied to them caused by the rotation of the front guide, and this causes variations in the wire characteristics.

In the second prior art, the printing wires in one row are supported by the opposing semicircular recesses, while the printing wires in the other row are supported by the semicircular recesses and the small irregularities. Since these printing wire support portions are not perfect holes, the printing quality degrades. In addition, small irregularities are readily worn during use. If the small irregularities are worn, the support of this row of printing wires becomes insufficient, resulting in a lowering in the printing quality. Further, it is likely that ribbon tailings, ink, printing paper dust, etc. will adhere to the recesses of the fixed guide plates. Therefore, there is a likelihood that the shafts of the movable guide will become unable to move satisfactorily due to adhesion of such dust, resulting in a failure to change over the printing modes.

The third prior art requires a solenoid for vertically moving the two guides and therefore provides an increase in the cost.

In the fourth prior art, since the front guide is rotated, printing wires which are close to the center of rotation and those which are remote from it have different amounts of torsion applied to them, which causes variations in the wire response characteristics. Further, since a solenoid is needed, the cost increases.

In addition, since the pitch of the printing wires in the vertical direction in the staggered arrangement differs from that in the parallel arrangement, the character size varies undesirably.

In the fifth prior art, since the printing wires are inclined by two front guides, the load applied to the wires increases, giving rise to problems in terms of response characteristics and durability. In addition, since the wire stroke in the parallel arrangement differs from that in the staggered arrangement, a difference is likely to be produced in printing characteristics.

SUMMARY OF THE INVENTION

Accordingly, it is a first object of the present invention to enable the printing wire arrangements to be changed over from one to another by the movement of the printing head alone, thereby eliminating the need for a solenoid and thus simplifying the arrangement.

It is a second object of the present invention to minimize the change in the amount of torsion on the printing wires caused by changeover of the printing wire arrangements, thereby stabilizing the printing characteristics and eliminating the difference in printing characteristics between the parallel and staggered arrangements and also improving the durability.

To attain the above-described objects, the present invention provides a wire-dot printer having a printing head that is moved on a carriage in the widthwise direction of a recording medium and that has a plurality of electromagnetically driven printing wires which are supported in aligned form in a nose portion of a head frame, in which a high-speed printing mode and a high-quality printing mode can be changed over from one to the other. Specifically, a pair of first and second front guides are provided on the nose portion in such a manner as to face each other in a direction in which the printing wires extend, to align front end portions of the printing wires in at least two rows, the first front guide being fixed to the nose potion, while the second front guide is fixed to a front guide supporting frame which is provided on the nose portion in such a manner as to be movable in a direction in which the front ends of the printing wires are aligned. The front guide supporting frame is movable with a stroke substantially half a pitch of the front ends of the printing wires, with the first and second front guides each having a plurality of guide holes that determine longitudinal positions of printing wires in each row, and an elongated groove through which a bundle of printing wires in each row extends and which is longer than the widthwise dimension of the bundle of printing wires by at least an amount corresponding to the stroke, the guide holes and the elongate groove being provided in parallel to each other, and the guide holes and the elongated groove provided in the first front guide respectively facing the elongated groove and the guide holes provided in the second front guide. A sliding member is provided on the head frame or a member that is in fixed relation to the head frame in such a manner that the sliding member projects from both sides of the head frame and is slidable substantially parallel to a direction of movement of the printing head, and the sliding member is displaced by abutting against a stationary member in the printer when the printing head is moved beyond a normal travel region.

A transmission-changeover means is provided between the sliding member and the front guide supporting frame for displacing the front guide supporting frame in response to displacement of the sliding member.

The transmission-changeover means preferably includes at least one transmission lever which slides or pivots in response to the displacement of the sliding member, a leaf spring which is secured at one end thereof to the head frame and engaged at the other end thereof with the transmission lever, and an engaging member which moves together with the front guide supporting frame as one unit and which engages with an intermediate portion of the leaf spring.

When the transmission lever is a member which slides in a direction substantially perpendicular to the direction of movement of the sliding member, a pinion that meshes with a rack provided on the sliding member may be provided, the pinion further meshing with a rack that is provided on the transmission lever.

When the transmission lever is a member which slides in a direction substantially perpendicular to the direction of movement of the sliding member, the transmission lever may be provided with a cam follower that engages with cam means provided on the sliding member.

The cam means may comprise a cam groove that is fitted with the cam follower. In this case, the cam groove preferably includes a pair of first and second elongated changeover grooves, which are elongated in the direction of movement of the sliding member and offset from each other in a direction substantially perpendicular to the direction of movement of the sliding member, and an inclined groove that connects together the elongated changeover grooves.

More preferably, a positioning means is provided for stabilizing either the sliding member or the transmission lever selectively in a high-speed printing position and a high-quality printing position.

The positioning means may include a click projection or a click recess provided on the sliding member, and a positioning leaf spring which is provided on the head frame or a member that is in fixed relation to the head frame, and which engages with the projection or the recess.

The positioning means may include biasing means that biases the sliding member toward a central position by a spring force when the sliding member is disposed in either of the high-speed and high-quality printing positions.

As the biasing means, a single compressed coil spring is preferably used. In this case, the sliding member is formed with an engaging groove in which the coil spring is loaded, and a pair of relatively narrow continuous grooves which extend from both ends of the engaging groove in the direction of movement of the sliding member, and the head frame or a member which is in fixed relation to the head frame is provided with engaging members which are disposed in the continuous grooves, respectively, at a predetermined spacing.

The stationary member may be a side plate of a printer frame or an abutting member that is secured thereto.

When the sliding member moves together with the head until it abuts against a stationary member in the printer and the sliding member then moves relative to the head in an opposite direction to the direction of movement of head, the front guide supporting frame moves in the direction of alignment of the front ends of the printing wires, causing one row of printing wires to move a half-pitch through the second front guide. Thus, the printing wire arrangement is changed over from the staggered arrangement to the parallel arrangement, or vice versa.

BRIEF DESCRIPTION OF THE DRAWINGS

In order that the invention may be more clearly understood, it will now be illustrated in greater detail with respect to the accompanying drawings, wherein:

FIG. 4(*b*) is an enlarged front view of a first front guide;

DESCRIPTION OF THE PREFERRED EMBODIMENTS

The present invention will be described below in detail by way of preferred embodiments and with reference to the accompanying drawings.

Figure 1:
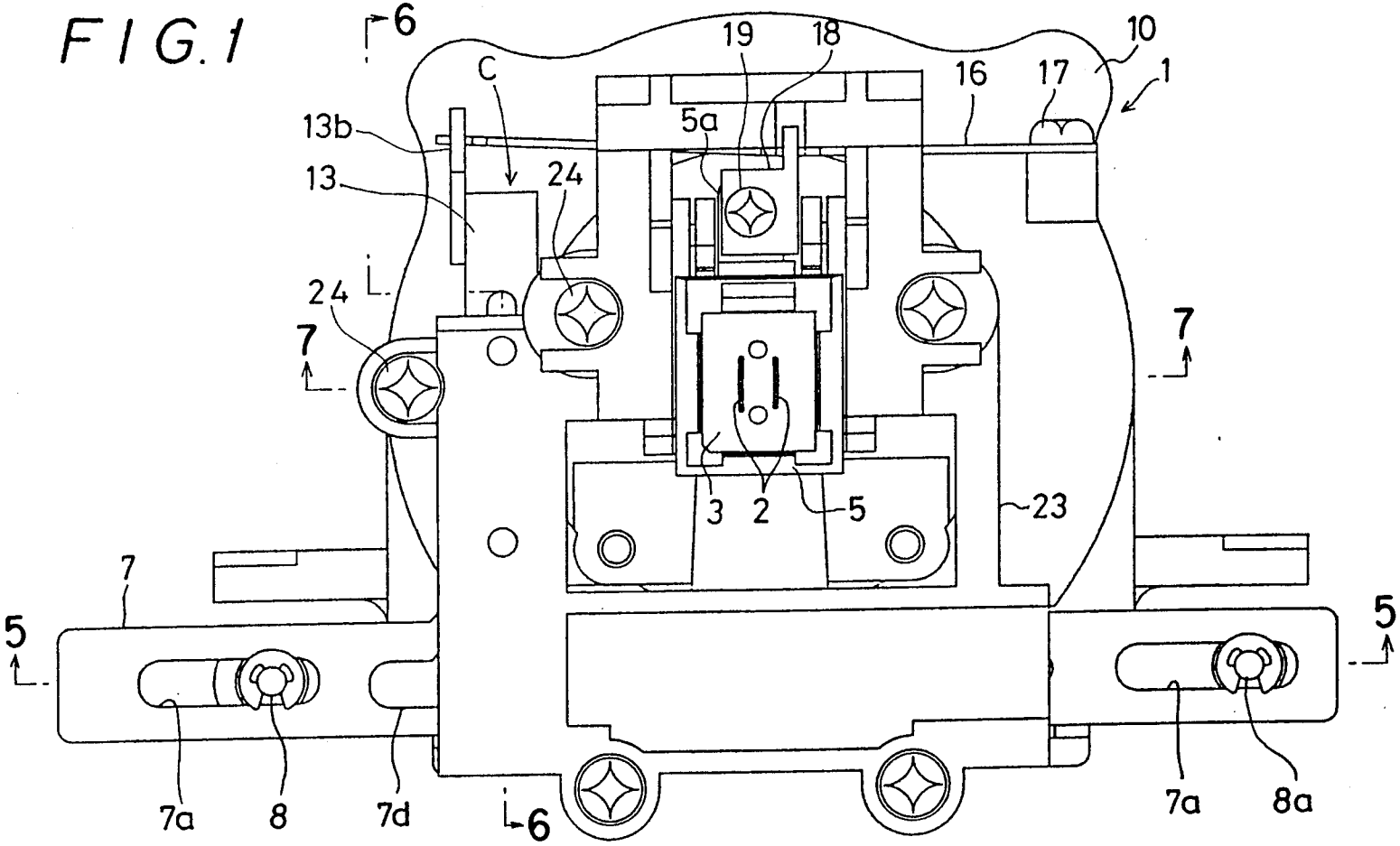
FIG. 1 is a front view of a printing head in one embodiment of the present invention.
Figure 5:
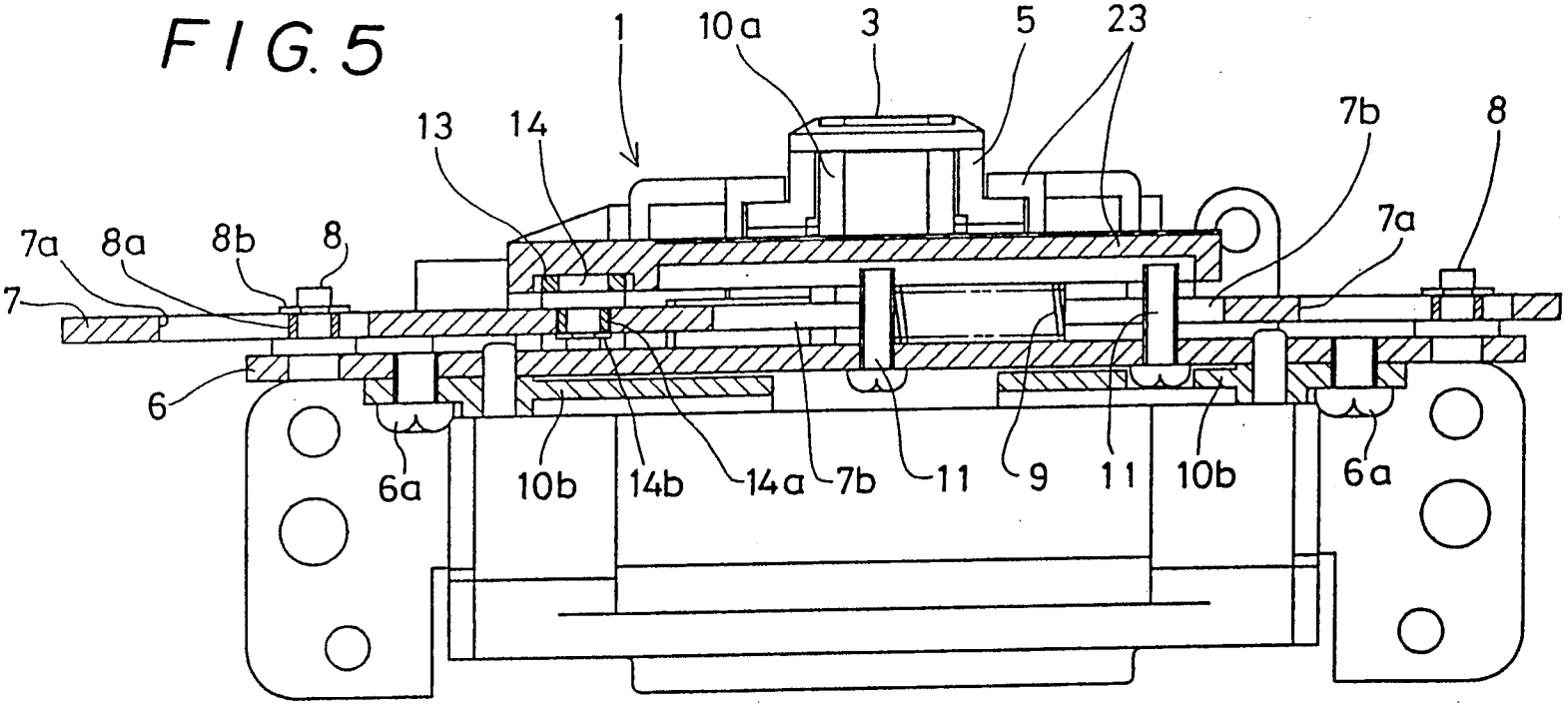
FIG. 5 is a sectional view taken along the line 5—5 in FIG. 1.
Figure 7:
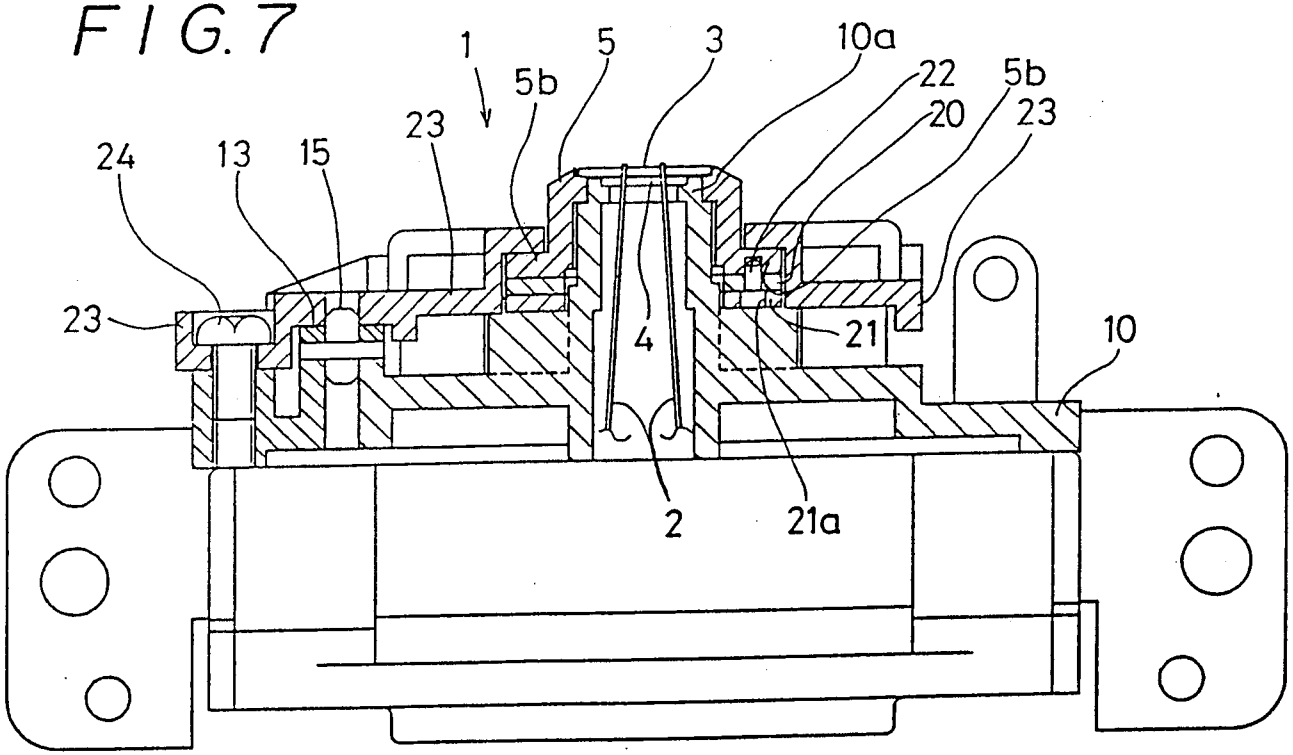
FIG. 7 is a sectional view taken along the line 7—7 in FIG. 1.

FIG. 1 is a front view of a wire-dot printing head 1. The printing head 1 is provided therein with an iron core, driving coil, printing lever, return spring, etc. (not shown), as components of an electromagnetic drive device, as shown in FIG. 5. Twenty-four printing wires 2 are secured to the distal end portion of the printing lever. When the printing lever advances by being attracted to the iron core, the printing wires 2 effect printing. Then, the printing wires 2 are withdrawn by resilient force from the return spring. As shown in FIG. 7, a head frame 10 is secured to the front side of the printing head body 1. The printing wires 2 extend through a nose potion 10*a* which projects forwardly from, the head frame 10. The printing wires 2 are aligned by a pair of first and second front guides 4 and 3.

As shown in FIG. 7, the first front guide 4 is secured to the front end of the nose portion 10*a* of the head frame 10 to serve as a fixed guide. The second front guide 3 is secured to a front guide supporting frame 5 which is provided so as to be vertically movable by a small amount relative to the first front guide 4.

Figure 4A:
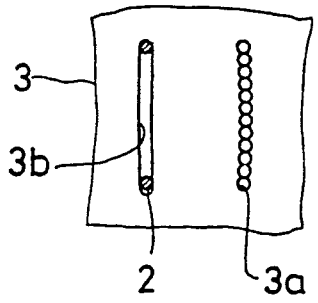
FIG. 4(*a*) is an enlarged front view of a second front guide.
Figure 4B:
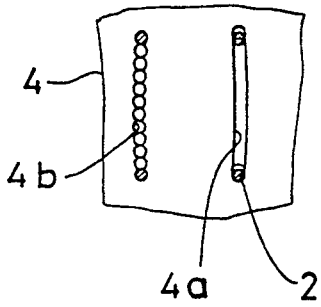

The second front guide 3, which is located forwardly of the first front guide 4, is provided with a guide hole 3*a* and an elongated groove 3*b*, which are parallel to each other, as shown in FIG. 4(*a*). The guide hole 3*a* comprises 12 circular holes aligned vertically in close proximity to each other so that one printing wire 2 extends through each hole. The elongated groove 3*b* is fitted with 12 printing wires 2 which are aligned vertically, with a clearance not smaller than a half-pitch left at the lower end of groove 3*b*.

The first front guide 4 is provided with an elongated groove 4*a* and a guide hole 4*b*, which are parallel to each other, as shown in FIG. 4(*b*). The elongated groove 4*a* is fitted with 12 printing wires 2 which are aligned vertically, with a clearance not smaller than a half-pitch left at the upper end of groove 4*a*. *The guide hole 4b* comprises 12 circular holes aligned vertically in close proximity to each other so that one printing wire 2 extends through each hole.

Figure 3:
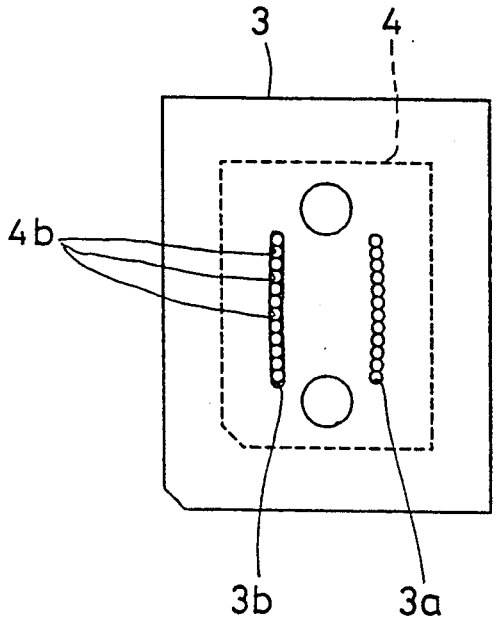
FIG. 3 is an enlarged front view of the front end portions of the printing wires.

As shown in FIG. 3, when the first and second first front guides 4 and 3 are superposed one upon the other, the elongated groove 4*a* faces the guide hole 3*a*, while the guide hole 4*b* faces the elongated groove 3*b*.

In the present invention, the parallel and staggered arrangements of the printing wires 2 are changed over from one to the other by vertical movement of the second front guide 3. When the second front guide 3 is at the lowered position, the guide holes 3*a* and 4*b* are disposed parallel to each other, so that among the 24 printing wires 2 the 12 printing wires 2 in one row extend through the guide hole 3*a* and the elongated groove 4*a*, and the 12 printing wires 2 in the other row extend through the elongated groove 3*b* and the guide hole 4*b*, as shown in FIG. 3. Thus the printing wires 2 are arranged in the parallel pattern.

The following is a description of an arrangement wherein the second front guide 3 is supported so as to be movable vertically.

Figure 2:
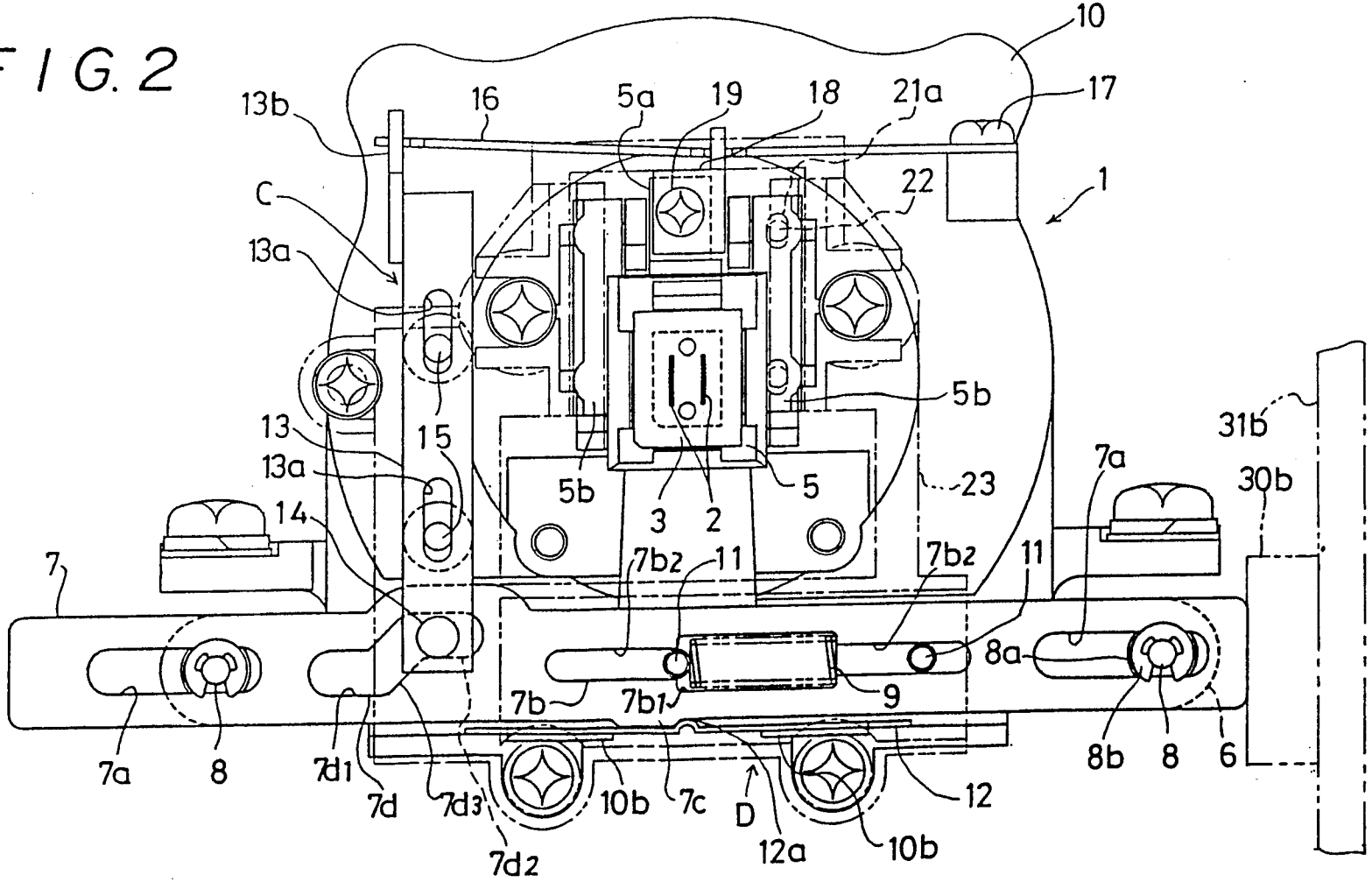
FIG. 2 is a front view of the printing head with a front cover removed therefrom.

As shown in FIGS. 2 and 5, a securing plate 6 for a bar is secured to supporting portions 10*b* at the lower side of the head frame 10 by using screws 6*a*. A sliding bar (sliding member) 7 is connected to the securing plate 6 so as to be movable sidewardly (horizontally). The sliding bar 7 is provided with elongated guide grooves 7*a*, which are elongated in the direction of movement. The securing plate 6 has roller pins 8 secured thereto. Rollers 8*a* are fitted on the respective roller pins 8. The rollers 8*a* are disposed in the elongated guide grooves 7*a*, respectively, and retaining E-shaped rings 8*b* are attached to the respective projecting ends of the top portions of the roller pins 8, thereby attaching the sliding bar 7 to the securing plate 6 in such a manner the sliding bar 7 can not be removed from the securing plate 6 and yet it is movable sidewardly. Accordingly, the sliding bar 7 is movable together with the head 1, and yet it is also movable relative to the head 1. The two end portions of the sliding bar 7 project sidewardly from the head 1.

Figure 8:
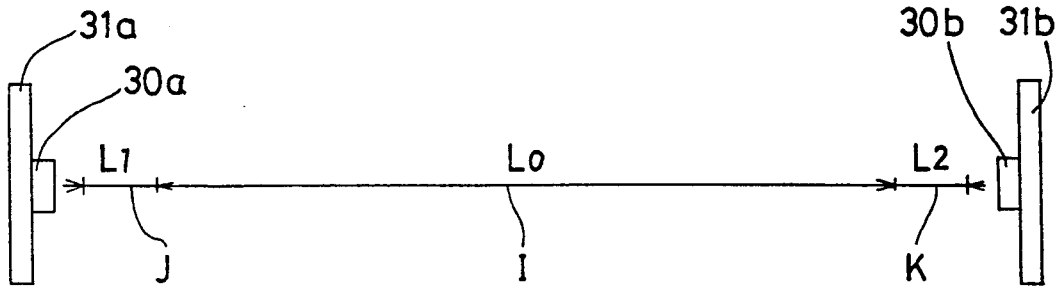
FIG. 8 illustrated the head travel range.

As shown in FIGS. 2 and 8, a side plate 31*a* or 31*b* that constitutes a supporting frame of the printer is provided with an abutting member (stationary member) 30*a* or 30*b* that abuts against the sliding bar 7. The side plate 31*a* or 31*b* and the abutting member 30*a* or 30*b* are provided at each side of the head travel region.

As shown in FIG. 8, the printing head 1 moves within a region I with a length $L_0$ between the abutting members 30*a* and 30*b* during the normal printing operation. When the staggered arrangement is to be changed over to the parallel arrangement, or vice versa, the printing head 1 moves in a region J or K beyond the region I, and when it moves by a length $L_1$ or $L_2$, the sliding bar 7 abuts against the abutting member 30*a* or 30*b*, so that the sliding bar 7 moves a predetermined distance in the opposite direction to the direction of movement of the head 1.

The sliding bar 7 and the head frame 10 are provided with positioning means D for the sliding bar 7, as shown in FIG. 2. More specifically, the central portion of the sliding bar 7 is provided with an aperture 7*b* which is elongated in the direction of movement. The central portion of the aperture 7*b* includes a spring engaging groove $7b_1$ in which a compressed coil spring 9, serving as a biasing means, is fitted. Continuous grooves $7b_2$ of aperture 7*b* which extend from both ends, respectively, of the engaging groove $7b_1$, have a narrower width than that of the engaging groove $7b_1$. A pair of pins (engaging members) 11, which extend from the securing plate 6, are fitted in the continuous groove $7b_2$, respectively, in such a manner that the pins 11 are movable relative to the grooves $7b_2$.

An inverted trapezoidal click projection 7*c* is provided on the lower end face of the central portion of the sliding bar 7, as shown in FIG. 2. A positioning leaf spring 12 is press-fitted in the gap between the sliding bar 7 and the support portions 10*b*. Thus, the leaf spring 12 is secured to the head frame 10. The leaf spring 12 is in resilient contact with the end face of the sliding bar 7. A clock projection 12*a* is formed in the center of the positioning leaf spring 12 by bending the central portion of the leaf spring 12. The projection 7*c* can ride over the projection 12*a* by pressing it so as to bend the positioning leaf spring 12. Thus, the projection 7*c* can be disposed at either of the right- and left-hand sides of the projection 12*a*.

Next, transmission-changeover means C will be explained.

Figure 6:
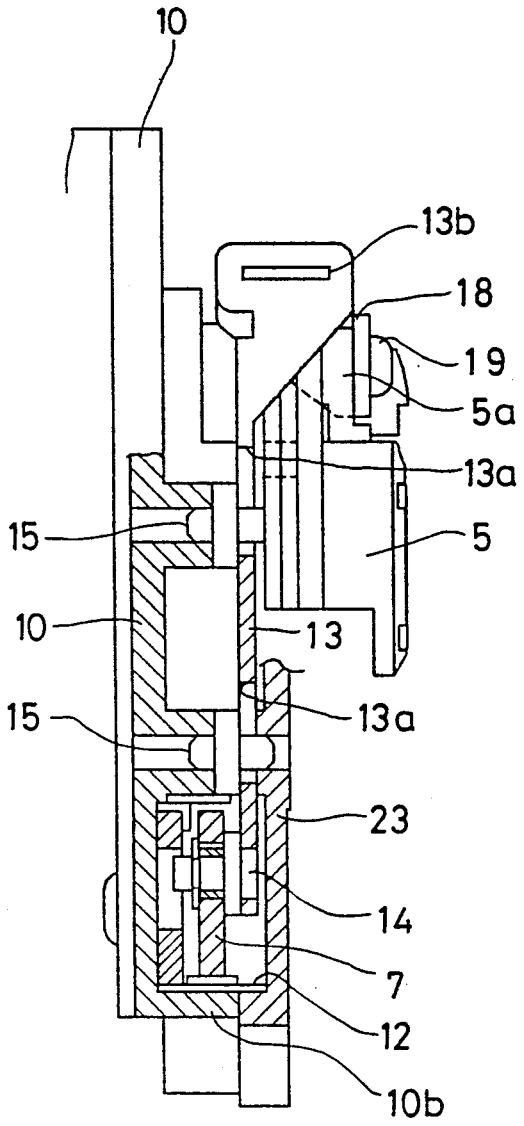
FIG. 6 is a sectional view taken along the line 6—6 in FIG. 1.

The sliding bar 7 is further provided with a cam groove 7*d*, which is arranged to convert the horizontal movement of the sliding bar 7 into vertical movement of a transmission lever 13. The cam groove 7*d* is provided at both ends thereof with a first elongated changeover groove $7d_1$ and a second elongated changeover groove $7d_2$, which are elongated in the direction of movement of the head 1 and which are offset from each other in a direction (vertical direction) perpendicular to the direction of movement of the head 1. These two changeover grooves are connected together by an inclined groove $7d_3$, which constitutes a central portion of the cam groove 7*d*. The length of the inclined groove $7d_3$ in the direction of movement is set shorter than the distance of sliding of the sliding bar 7, as described later. A roller pin (cam follower) 14, which is provided on the transmission lever 13, is fitted in the cam groove 7*d*. The arrangement of the roller pin 14 is the same as those of the roller pins 8, which have been described above. The roller pin 14 is provided with a roller 14*a* and a retaining ring 14*b*, as shown in FIG. 5. As shown in FIGS. 2 and 6, the transmission lever 13 is movable vertically at right angles to the sliding bar 7. The transmission lever 13 is provided with elongated grooves 13*a*, which are elongated in the direction of movement thereof. Supporting pins 15, which are press-fitted into the head frame 10, are fitted in the elongated grooves 13*a*, respectively. The upper end portion of the transmission lever 13 is provided with a connecting hole 13*b* for connecting a leaf spring 16 which is used as a pressing spring.

As shown in FIGS. 1 and 2, the leaf spring 16 is supported at one end (right-hand end) thereof on the head frame 10 by a screw 17 in a cantilever fashion. The leaf spring 16 pierces at an intermediate portion thereof which is closer to the screw 17 through a connecting hole provided in an engaging member 18, described later, and it further pierces at the other end (left-hand end) thereof through the connecting hole 13*b*. In this way, the leaf spring 16 is connected to the transmission lever 13.

When the sliding bar 7 moves sidewardly relative to the printing head 1, the roller pin 14 enters either the first or second elongated changeover groove $7d_1$ or $7d_2$, as will be described later. When the roller pin 14 enters the first elongated changeover groove $7d_1$, the leaf spring 16 bends downwardly, applying upward resilient force to the transmission lever 13, whereas, when the roller pin 14 enters the second elongated changeover groove $7d_2$, the leaf spring 16 bends upwardly, applying downward resilient force to the transmission lever 13. With this resilient force, the roller pin 14 is pressed against the upper groove surface when it is in the first elongated changeover groove $7d_1$; and when the roller pin 14 is in the second elongated changeover groove $7d_2$, it is pressed against the lower groove surface. Since the first and second elongated changeover grooves $7d_1$ and $7d_2$ extend parallel to each other in the direction of movement of the head 1, the roller pin 14 is accurately positioned in the vertical direction by the first and second elongated changeover grooves $7d_1$ and $7d_2$. The amount of vertical displacement of the roller pin 14 between the two grooves $7d_1$ and $7d_2$ is set equal to the amount of vertical movement of the transmission lever 13.

The engaging member 18, which connects together the front guide supporting frame 5 and the leaf spring 16, is secured to a connection portion 5*a* provided at the upper end of the front guide supporting frame 5 by using a screw 19. Means for enabling the front guide supporting frame 5 to slide vertically and for determining the stroke thereof comprises two guide plates 20 and 21 and sliding pins 22, which are interposed at the rear side of the front guide supporting frame 5, as shown in FIGS. 2 and 7. the front guide supporting frame 5 has two flanges 5*b* projecting respectively from two sides thereof. The first guide plate 20 is secured to the flanges 5*b*, while the second guide plate 21 is secured to a portion of the head frame 10 which faces the flanges 5*b*. The sliding pins 22 are secured to the first guide plate 20 by press fitting. The second guide plate 21 is formed with elongated grooves 21*a* in which the sliding pins 22 are fitted and movable by the stroke for changing over the wire arrangement from the staggered arrangement to the parallel arrangement, and vice versa.

By virtue of the above-described arrangement, the sliding part that is associated with the vertical movement of the front guide supporting frame 5 is defined between the first and second guide plates 20 and 21. Therefore, there is no possibility that dust or the like that is generated in the vicinities of the front ends of the printing wires 2 by the printing operation will be attached to the sliding part. Thus, it is possible to prevent the printing operation from becoming unstable due to dust or other foreign matter.

As shown in FIGS. 1 and 5 to 7, the front side of the head frame 10 is covered with a front cover 23, and the cover 23 is secured by using screws 24 for retaining the front guide supporting frame 5, the sliding bar 7, the biasing means 9, the transmission lever 13 and the leaf spring 16 so that these components will not be removed.

Next, the operation will be explained. FIG. 2 shows a state where the printing wires 2 are arranged in the staggered pattern, which is suitable for high-quality printing. More specifically, when the printing head 1 is moved from the left to the right, as viewed in FIG. 2, beyond the normal travel region I by length $L_2$, the sliding bar 7 abuts against the abutting member 30*b* to stop the movement, so that the sliding bar 7 moves leftwardly relative to the head 1 in the opposite direction to the direction of movement of the head 1, thereby allowing the printing wires 2 to be arranged in the staggered pattern.

That is, when the sliding bar 7 moves leftwardly relative to the head 1, the projection 7*c* rides over the projection 12*a* from the right to the left by pressing it so that the leaf spring 12 is bent. As a result, the projection 7*c* is situated at the left-hand side of the projection 12*a*, as illustrated in FIG. 2. This position is maintained stably by the action of the biasing means 9. More specifically, with the left-hand end of the biasing means 9 abutting against the left-hand pin 11, and with the right-hand end of the biasing means 9 engaged with the right-hand end of the spring engaging groove $7b_1$, the biasing means 9 is compressed so as to bias the sliding bar 7 rightwardly. Thus, the spring force from the compressed coil spring 9 balances with the spring force from the positioning leaf spring 12.

Before the movement, the roller pin 14 is disposed in the first elongated changeover groove $7d_1$ in the changeover groove 7*d*. However, as the sliding bar 7 moves leftwardly, the roller pin 14 moves to the second elongated changeover groove $7d_2$ through the inclined groove $7d_3$. Since the first and second elongated changeover grooves $7d_1$ and $7d_2$ are offset from each other in the vertical direction so that the second elongated changeover groove $7d_2$ is above the first elongated changeover groove $7d_1$, the roller pin 14 moves upwardly, causing the transmission lever 13 to move upwardly. Consequently, an upward load is applied to the left-hand end of the leaf spring 16.

Since the leaf spring 16 is supported by the screw 17 in a cantilever fashion, a load which is larger than the load applied to the distal end portion of the leaf spring 16 is applied to the front guide supporting frame 5 from the intermediate portion of the leaf spring 16 through the engaging member 18 on the basis of the principles of the lever. As the front guide supporting frame 5 moves upwardly by receiving the load applied by the upward bending of the leaf spring 16, the second front guide 3 has the guide hole 3*a* for the right-hand row, which comprises holes receiving the printing wires 2 individually, and the elongated groove 3*b*, which has a clearance at the lower end thereof. Therefore, as the second front guide 3 moves upwardly, only the 12 printing wires 2 in the right-hand row, which extend through the guide hole 3*a*, move a half-pitch upwardly, while the 12 printing wires 2 in the left-hand row are left restrained by the left-hand row guide hole 4*b* in the first front guide 4. As a result, the 24 printing wires 2 are arranged in the staggered pattern.

To change over the staggered arrangement to the parallel arrangement, which is suitable for high-speed printing, the printing head 1 is moved from the right to the left beyond the travel region I by length $L_1$, causing the sliding bar 7 to move rightwardly relative to the head 1, in the reverse manner to the above. At this time, the projection 7c rides over the projection 12a from the left to the right and is situated at the right-hand side of the projection 12a, and the coil spring 9 is compressed with the right-hand end thereof abutting against the right-hand pin 11, so that the sliding bar 7 is biased leftwardly by the spring force of spring 9. Thus, the sliding bar 7 is maintained stably in this position. Further, the roller pin 14 moves to the first elongated changeover groove $7d_1$, so that the transmission lever 13 moves downwardly, causing the leaf spring 16 to bend downwardly. Consequently, the front guide supporting frame 5 is moved downwardly, causing the second front guide 3 to move downwardly. As the second front guide 3 moves downwardly, only the 12 printing wires 2 extending through the right-hand row guide hole 3a move downwardly by a half-pitch. The 12 printing wires 2 in the left-hand row are left restrained by the left-hand row guide hole 4b in the first front guide 4. As a result, the 24 printing wires 2 are arranged in the parallel pattern.

According to the present invention, since the front guide is not rotated to change over the printing wire arrangement to the staggered arrangement or the parallel arrangement, the pitch of the printing wires in the vertical direction will not change, whether in the staggered arrangement or the parallel arrangement. Therefore, there is no substantial change in the character size.

Next, the function of positioning means D will be explained.

To change over the parallel arrangement to the staggered arrangement, for example, the printing head 1 is moved from the left to the right, as viewed in FIG. 2. In this operation, the printing head 1 may be moved to the right beyond the normal travel region I in excess of length $L_2$, shown in FIG. 8, due to some error in the movement of the printing head 1. In such a case, the sliding bar 7 projects leftwardly from the printing head 1 more than is needed. If the printing head 1 is moved in the travel region I in this state to effect full-scale printing, there is a likelihood that the left-hand end of the sliding bar 7 will abut against the abutting member 30a, causing the sliding bar 7 to be damaged, or causing the staggered arrangement to be undesirably changed over to the parallel arrangement. The positioning means D allows the projection 7c to abut against the left-hand side of the projection 12a, thereby maintaining the sliding bar 7 in a correct position relative to the head 1, and thus preventing the occurrence of the above-described problems. The same function is also available when the staggered arrangement is changed over to the parallel arrangement.

It should be noted that the elongated grooves 4a and 3b serve to prevent the printing wires 2 from being caught in the ribbon, but they are not guides used for the printing wires 2 when they project. Therefore, the lateral width of these elongated grooves may be much greater than the diameter of the wires 2.

Figure 9:
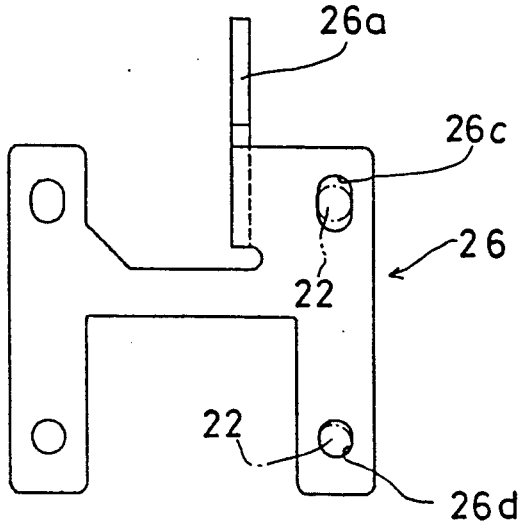
FIG. 9 is a fragmentary front view of another embodiment of the present invention.
Figure 10:
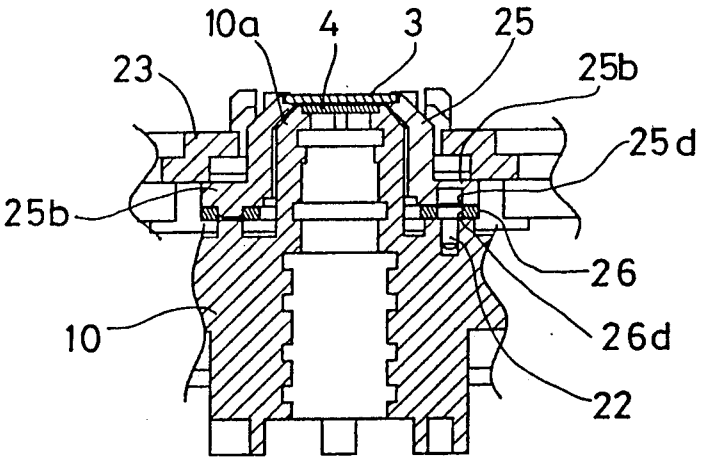
FIG. 10 is a fragmentary sectional view of the second embodiment.
Figure 11:
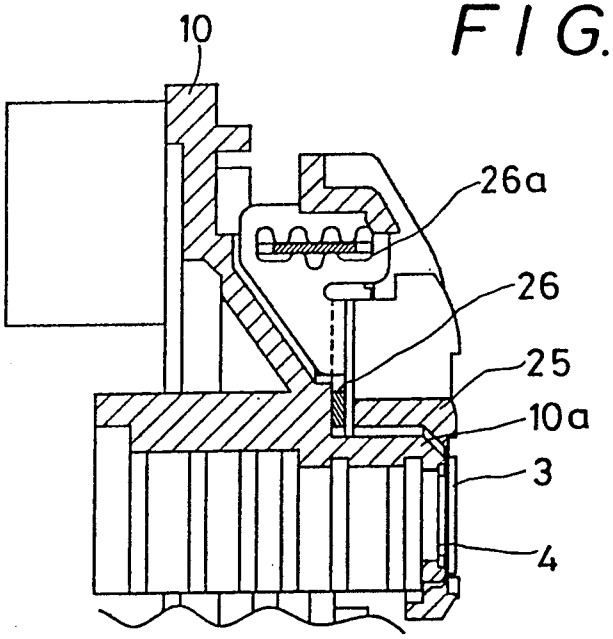
FIG. 11 is a fragmentary sectional view of the second embodiment.

FIGS. 9 to 11 show another embodiment, in which the arrangement of the part including the front guide supporting frame is simplified. Although in the above-described embodiment the front guide supporting frame 5, the spring engaging member 18, and the first and second guide plates 20 and 21 are discrete parts and these parts are secured by means of the screw 19 or bonding, in this embodiment the spring engaging member and the first guide plate of the first embodiment are formed together in one unit, which is defined as a guide plate 26, and the second guide plate in the first embodiment is omitted. More specifically, the upper end portion (engaging member) of the guide plate 26 is projected to form a connecting portion 26a for connection with the leaf spring. Further, as shown in FIGS. 9, 10 and 11, sliding pins 22 are secured to the wire frame 10 as in the first embodiment, and the guide plate 26 is secured to flanges 25b of a front guide supporting frame 25. In addition, the guide plate 26 is provided with elongated grooves 26c and 26d which are movable relative to the sliding pins 22. The longitudinal length of the elongated groove 26d is longer than the diameter of the sliding pin 22 by a half-pitch of the printing wires so that the elongated groove 26d limits the stroke of the front guide supporting frame 25. The flanges 25b of the front guide supporting frame 25 are provided with elongated grooves (not shown) corresponding to grooves 26c and elongated grooves 25d corresponding to grooves 26d, which have the same planar configuration, and are at respective positions facing the elongated grooves 26c and 26d.

Figure 12:
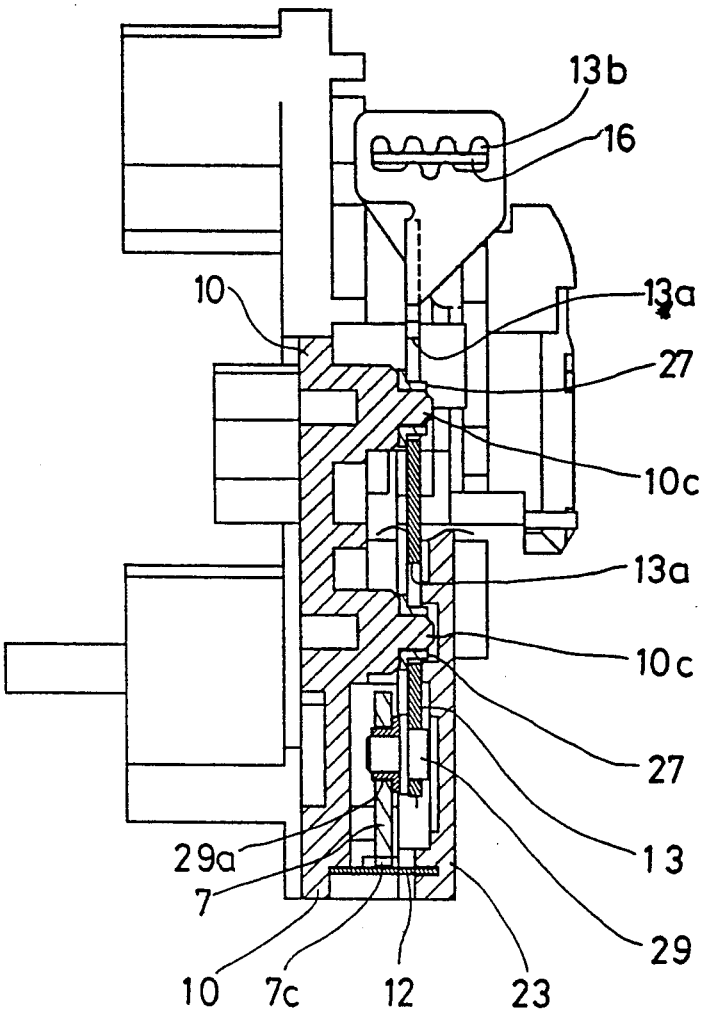
FIG. 12 is a fragmentary sectional view of still another embodiment of the present invention.

FIG. 12 shows another embodiment, in which the supporting pins 15 used in the above-described embodiment to movably attach the transmission lever 13 to the head frame 10 are omitted to simplify the arrangement and to also simplify the assembly by elimination of the need for a press fitting process. More specifically, projections 10c are provided on the head frame 10 as integral parts of the latter, and rollers 27 with a flange are fitted on the projections 10c. It should be noted that the rollers 27 do not necessarily need to be provided.

Figure 13:
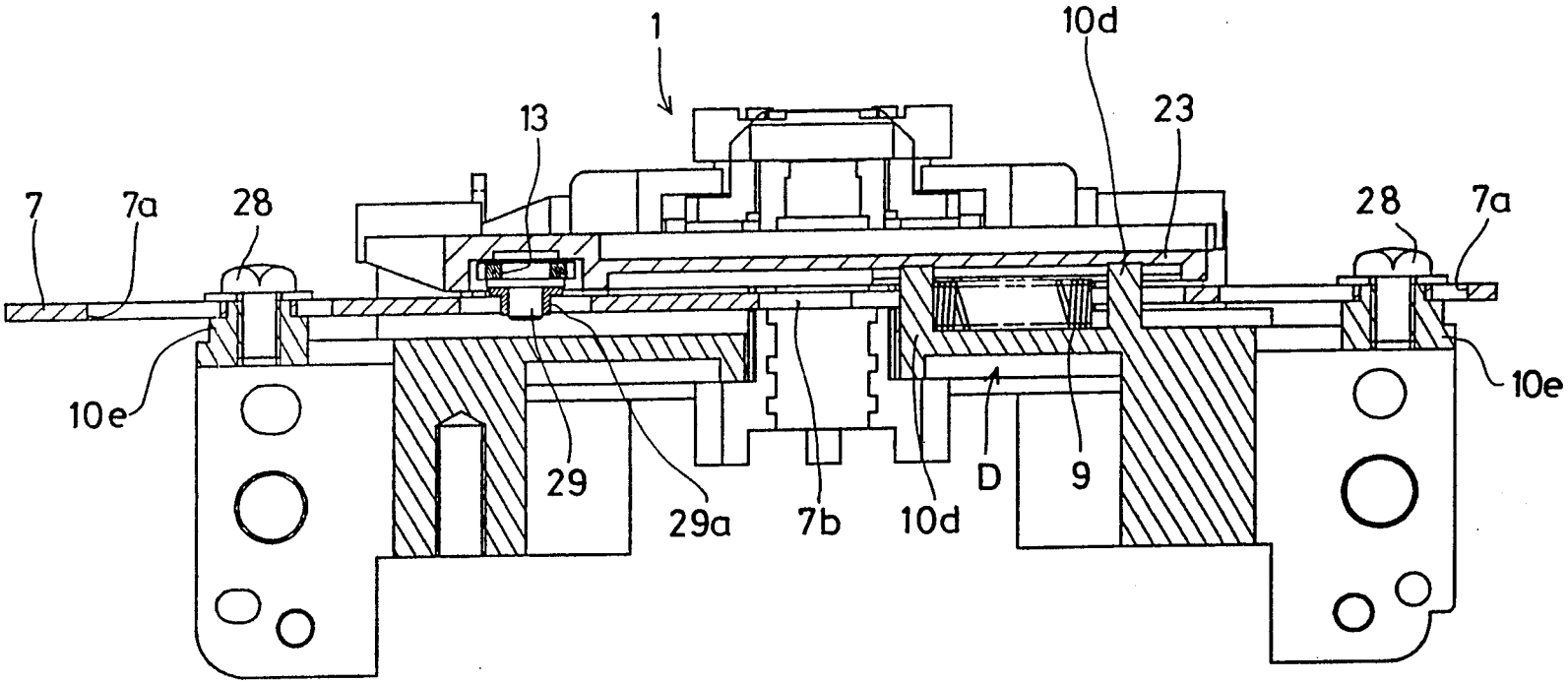
FIG. 13 is a partly-sectioned side view of a further embodiment of the present invention.

FIG. 13 shows another embodiment, in which the lever securing plate 6 in the above-described embodiment is omitted to simplify the arrangement. More specifically, positioning pins 10d are provided on the head frame 10, and these pins are fitted into the positioning aperture 7b in the sliding bar 7. In addition, the roller pins 8, which are used in the above-described embodiment to attach the sliding bar 7, are replaced with base poles 10e which are provided on the head frame 10 as integral parts of the latter, and screws 28 are screwed into these poles, thereby eliminating the need for retaining E-shaped rings, and thus achieving simplification of the assembly.

FIGS. 12 and 13 show another embodiment, in which the roller pin 14 having the roller 14a and the retaining ring 14b, which is used in the above-described embodiment to connect together the sliding bar 7 and the transmission lever 13, is replaced with a roller pin 29 equipped with a roller 29a with flange. In this arrangement, the assembly is simplified by eliminating the need to use a retaining ring.

It should be noted that in the above-described embodiments substantially the same elements or portions are denoted by the same reference numerals.

In addition, the roller 29a with flange is not always necessary. Further, it is not always necessary to provide a roller between each elongated guide groove 7a and the corresponding base pole 10e.

In addition, the means for converting the movement of the sliding bar into the movement of the transmission lever is not necessarily limited to the combination of the cam groove 7d and the roller pin 14 as in the above-described embodiment.

Figure 14:
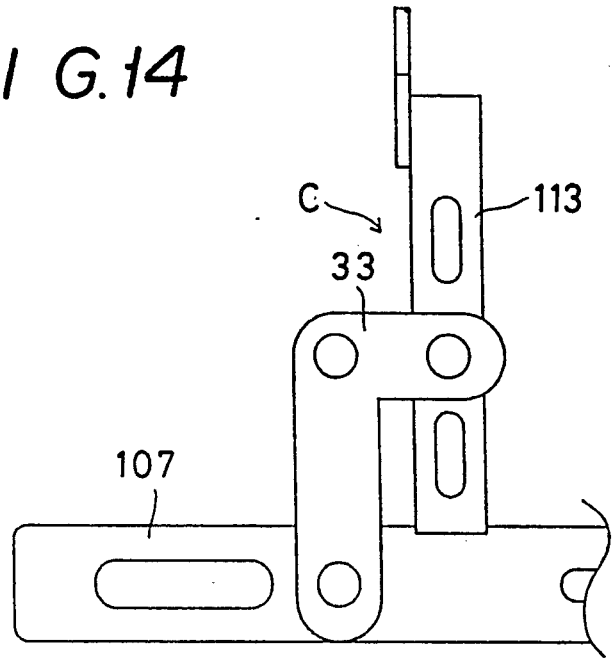
FIG. 14 is a fragmentary front view of a still further embodiment of the present invention.
Figure 15:
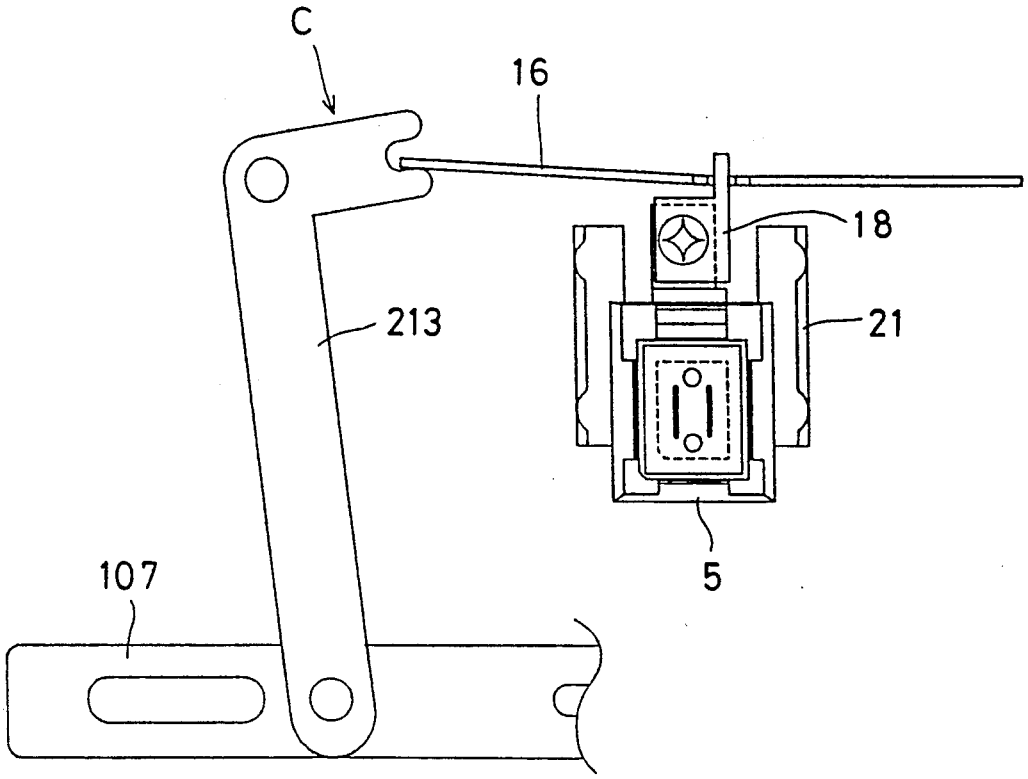
FIG. 15 is a fragmentary front view of a still further embodiment of the present invention.

That is, link mechanisms such as those shown in FIGS. 14 and 15 may be employed. In FIG. 14, a sliding ba (sliding member) 107 causes a transmission lever 113 to move up and down through a transmission lever 33 provided on the printing head (not shown). In FIG. 15, a sliding bar 107 causes a transmission lever 213 to rotate to thereby move the leaf spring 16.

Figure 16:
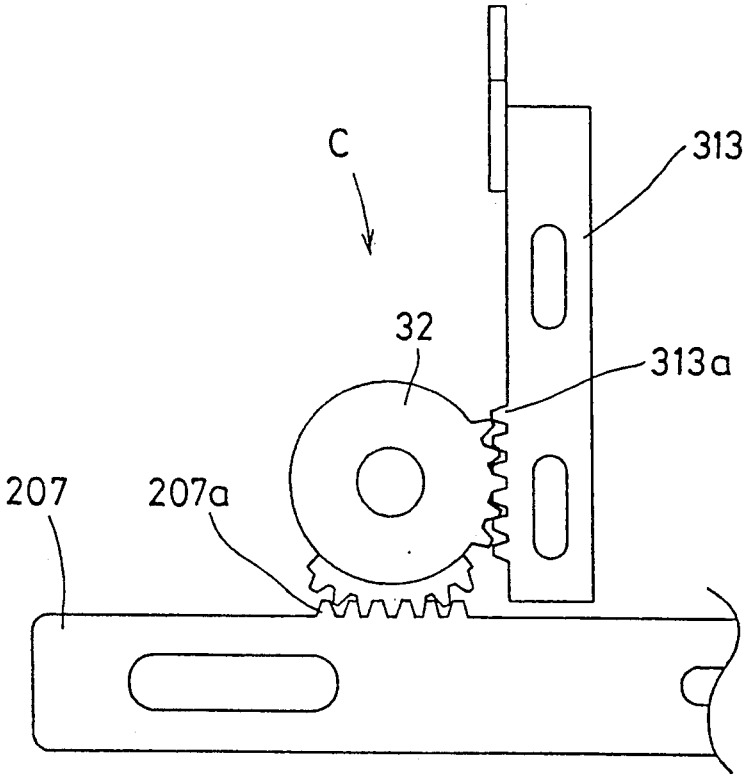
FIG. 16 is a fragmentary front view of a still further embodiment of the present invention.

It is also possible to employ a rack-and-pinion mechanism as shown in FIG. 16. More specifically, a sliding bar (sliding member) 207 and a transmission lever 313 are formed with racks 207*a* and 313*a*, respectively, while a pinion 32 is provided on the printing head (not shown), and these three are meshed with each other, thereby allowing the transmission lever 313 to move up and down. The stroke of the transmission lever 313 is limited by localizing teeth provided on the racks or those on the pinion.

In addition, the positioning means for the sliding bar is not necessarily limited to that described in the above embodiment. Although in the above-described embodiment the positioning means D for limiting the stroke is installed on the sliding bar 7, it may also be provided on the transmission lever 13, 113 or 313.

Figure 17:
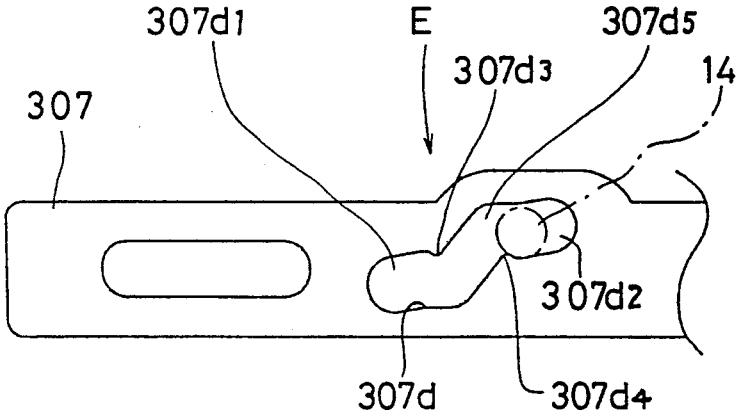
FIG. 17 is a fragmentary front view of a still further embodiment of the present invention.

For example, as shown in FIG. 17, the coil spring 9 and the positioning leaf spring 12 in FIG. 2 are omitted, but a cam groove 307*d* in a sliding bar (sliding member) 307 is provided with a part of positioning means E instead. More specifically, the cam groove 307*d* is composed of a first elongated changeover groove $307d_1$ which is slightly inclined, a second elongated changeover groove $307d_2$, an inclined groove $307d_5$ which communicates with both the elongated changeover grooves $307d_1$ and $307d_2$, and positioning projections $307d_3$ and $307d_4$. That is, the functions of the coil spring 9 and the positioning leaf spring 12 are performed by the leaf spring 16 and the pair of projections $307d_3$ and $307d_4$, respectively. For example, when the printing head (not shown) moves rightwardly and the sliding bar 307 eventually abuts against the abutting member, causing the roller pin 14 to enter the second elongated changeover groove $307d_2$, the printing head may be moved to the right beyond the normal travel region I in excess of length $L_2$, shown in FIG. 8, due to some error in the movement of the printing head. In such a case, the sliding bar 307 moves leftwardly beyond the position shown in FIG. 17. At this time, the roller pin 14 faces a portion of the lower groove surface of the second elongated changeover groove $307d_2$ which is rightward of the portion that is shown in FIG. 17. The lower groove surface of the second elongated changeover groove $307d_2$ slants upwardly toward the right-hand side as viewed in FIG. 17, and the roller pin 14 is pressed downwardly by the leaf spring 16. Therefore, the sliding bar 307 is returned rightwardly by the pressing force applied to the roller pin 14 by an amount corresponding to the distance by which it was first moved leftwardly beyond the position shown in FIG. 17, and the sliding bar 307 is positioned with the positioning projection $307d_4$ abutting against the roller pin 14. The same function is also available when the roller pin 14 is in the first elongated changeover groove $307d_1$.

Further, the arrangement may be such that no coil spring 9 is provided, but the inclined grooves $307d_1$ and $307d_2$, shown in FIG. 17 are employed instead., In this case, the function of the biasing means 9 is performed by the leaf spring 16, and the positioning leaf spring 12 is used as it is.

As has been described above, the present invention is arranged such that the second front guide is moved vertically in response to the movement of the printing head to thereby change over the parallel and staggered arrangements from one to the other. Accordingly, no solenoid is needed, and thus the changeover arrangement can be simplified. It is therefore possible to meet both the demand for higher printing speed and the demand for an improvement in the printing quality. Since the first and second front guides enable the printing wires to be guided uniformly with the entire circumference of each guide hole, the printing quality can be improved. Since printing wires aligned in one of the two rows move only a half-pitch, the amount of torsion of each printing wire is small and uniform. Accordingly, the printing characteristics are uniform and stable, whether in the parallel arrangement or the staggered arrangement, and the durability can be improved. Since the printing wires are not inclined at the front ends thereof, the load applied to the wires is minimized, so that the response characteristics and the durability can be improved. In addition, since positioning means for the sliding member or the transmission lever is provided, these members can be stabilized in a position reached by the movement thereof. Further, since the leaf spring is supported on the head frame in a cantilever fashion with the other end of the leaf spring engaged with the transmission lever, and an engaging member is engaged with an intermediate portion of the leaf spring, the sliding member requires only minimal force to move the transmission lever in order to move the transmission-changeover means. Accordingly, the load needed to move the sliding member is minimized.

Although the present invention has been fully described by way of example with reference to the accompanying drawings, it is to be understood that various changes and modifications will be apparent to those skilled in the art. Therefore, unless such changes and modifications depart from the scope of the invention, they should be construed as being included therein.

What I claim is:

1. A wire-dot printer having a printing head which is moved on a carriage in a widthwise direction of a recording medium and which has a plurality of electromagnetically driven printing wires which are supported in aligned form in a nose portion of a head frame and wherein a high-speed printing mode and a high-quality printing mode can be changed over from one to the other, said printer comprising:

first and second front guides provided on said nose portion in such a manner as to face each other in a direction in which bundles of said printing wires extend to align front end portions of said printing wires in at least two rows with the distance between said front end portions in each row being the pitch;

said first front guide being fixed to said nose portion, a front guide supporting frame provided on said nose portion, said second front guide being fixed to said front guide supporting frame, said front guide supporting frame being movable in a direction perpendicular to the direction of movement of the printing head on the carriage, said front guide supporting frame being movable with a stroke substantially equal to half a pitch of the front ends of said printing wires;

said first and second front guides each having a plurality of guide holes in at least one row that determine the positions of said printing wires in said at least one row, and at least one elongated groove through which the bundle of printing wires in each row extend and which is longer than the length of said bundle of printing wires in said groove by at least an amount corresponding to said stroke, said row of guide holes and said elongated groove being parallel to each other, said row of guide holes and said elongated groove in said first front guide respectively facing said elongated groove and said row of guide holes in said second front guide;

a sliding member provided on said head frame in such a manner that said sliding member projects from both sides of said head frame and is slidable substantially parallel to the direction of movement of said printing head on said carriage;

a stationary member on said printer, said sliding member being displaced by abutting against said stationary member on said printer when said printing head is moved beyond a normal travel region;

transmission-changeover means provided between said sliding member and said front guide supporting frame for displacing said front guide supporting frame in response to displacement of said sliding member;

said transmission-changeover means including at least one transmission lever which slides or pivots in response to the displacement of said sliding member, a leaf spring secured at one end thereof to said head frame and engaged at the other end thereof with said transmission lever, and an engaging member which moves together with said front guide supporting frame as one unit and which engages with an intermediate portion of said leaf spring;

said transmission lever being a member which slides in a direction substantially perpendicular to the direction of movement of said sliding member, and a pinion that meshes with a rack provided on said sliding member is provided, said pinion further meshing with a rack that is provided on said transmission lever.

2. A wire-dot printer comprising:

a printing head for movement in a widthwise direction of a recording medium, said printing head including:

a printing head for movement in a widthwise direction of a recording medium, said printing head including:

a head frame having a nose portion;

a plurality of electromagnetically driven printing wires supported in alignment in the nose portion, said wire having front ends arranged in rows with the distance between said front ends in each row being the pitch;

a front guide supporting frame movably mounted on said nose portion for movement in a direction perpendicular to said widthwise direction a stroke distance equal to substantially one-half of a pitch of the front ends of said printing wires;

means for changing the alignment of said wires between an arrangement for printing in a high-speed printing mode and an arrangement for printing in a high-quality printing mode, said means for changing the alignment comprising:

first and second front guide means for aligning front end portions of said printing wires in at least two rows, said first and second front guide means being provided on said nose portion so as to face each other in a direction in which said printing wires extend, said first front guide means being fixed to said nose portion, said second front guide means being fixed to said front guide supporting frame, and each of said first and second guide means having:

a plurality of guide holes for determining the position of the printing wires in each row; and an elongated groove through which a bundle of printing wires in each row extends, said groove having a length greater than the lengthwise dimension of said bundle of printing wires by an amount at least corresponding to said stroke;

said guide holes and said groove being provided substantially parallel to each other; and said guide holes and said elongated groove provided in said first front guide means facing said elongated groove and said guide holes, respectively, provided in said second front guide means;

a sliding member slidably mounted on said head frame for movement in a direction substantially parallel to said widthwise direction, said sliding member projecting from opposite sides of said head frame;

stationary means for displacing said sliding member when said sliding member abuts against said stationary member upon movement of said printing head beyond a normal travel region;

transmission changeover means for displacing said front guide supporting frame in response to said sliding member, said transmission changeover means being provided between said sliding member and said front guide supporting frame;

said transmission means comprising a transmission lever which moves in response to displacement of said sliding member, a leaf spring having one end secured to said head frame and an opposite end engaged with said transmission lever, and engaging member means for engaging with an intermediate portion of said leaf spring to move said front guide supporting frame for movement in said first direction;

said transmission lever being mounted for slidable movement in a direction substantially perpendicular to said second direction, said sliding member including a first rack and said transmission lever including a second rack, said transmission changeover means further including piston means for meshing with said first and second racks.

3. A wire-dot printer having a printing head which is moved on a carriage in a widthwise direction of a recording medium and which has a plurality of electromagnetically driven printing wires which are supported in aligned form in a nose portion of a head frame and wherein a high-speed printing mode and a high-quality printing mode can be changed over from one to the other, said printer comprising:

first and second front guides provided on said nose portion in such a manner as to face each other in a direction in which bundles of said printing wires extend to align front end portions of said printing wires in at least two rows with the distance between said front end portions in each row being the pitch;

said first front guide being fixed to said nose portion, a front guide supporting frame provided on said nose portion, said second front guide being fixed to said front guide supporting frame, said front guide supporting frame being movable in a direction perpendicular to the direction of movement of the printing head on the carriage, said front guide supporting frame being movable with a stroke substantially equal to half a pitch of the front ends of said printing wires;

said first and second front guides each having a plurality of guide holes in at least one row that determine the positions of said printing wires in said at least one row, and at least one elongated groove through which the bundle of printing wires in each row extends and which is longer than the length of said bundle of printing wires in said groove by at least an amount corresponding to said stroke, said row of guide holes and said elongated groove being parallel to each other, said row of guide holes and said elongated groove in said first front guide respectively facing said elongated groove and said row of guide holes in said second front guide;

a sliding member provided on said head frame in such a manner that said sliding member projects from both sides of said head frame and is slidable substantially parallel to the direction of movement of said printing head on said carriage;

a stationary member on said printer, said sliding member being displaced by abutting against said stationary member on said printer when said printing head is moved beyond a normal travel region;

transmission-changeover means provided between said sliding member and said front guide supporting frame for displacing said front guide supporting frame in response to displacement of said sliding member;

said transmission-changeover means including at least one transmission lever which slides or pivots in response to the displacement of said sliding member, a leaf spring secured at one end thereof to said head frame and engaged at the other end thereof with said transmission lever, and an engaging member which moves together with said front guide supporting frame as one unit and which engages with an intermediate portion of said leaf spring, said transmission lever being a member which slides in a direction substantially perpendicular to the direction of movement of said sliding member and which has a cam follower that engages with cam means provided on said sliding member, said cam means being a cam groove that is fitted with said cam follower, said cam groove including a pair of first and second elongated changeover grooves which are elongated in the direction of movement of said sliding member and offset from each other in a direction substantially perpendicular to the direction of movement of said sliding member, and an inclined groove that connects together said elongated changeover grooves.

4. A wire-dot printer having a printing head which is moved on a carriage in a widthwise direction of a recording medium and which has a plurality of electromagnetically driven printing wires which are supported in aligned form in a nose portion of a head frame and wherein a high-speed printing mode and a high-quality printing mode can be changed over from one to the other, said printer comprising:

first and second front guides provided on said nose portion in such a manner as to face each other in a direction in which bundles of said printing wires extend to align front end portions of said printing wires in at least two rows with the distance between said front end portions in each row being the pitch;

said first front guide being fixed to said nose portion, a front guide supporting frame provided on said nose portion, said second front guide being fixed to said front guide supporting frame, said front guide supporting frame being movable in a direction perpendicular to the direction of movement of the printing head on the carriage, said front guide supporting frame being movable with a stroke substantially equal to half a pitch of the front ends of said rows of printing wires;

said first and second front guides each having a plurality of guide holes in at least one row that determine the positions of said printing wires in said at least one row, and at least one elongated groove through which the bundle of printing wires in each row extends and which is longer than the length of said bundle of printing wires in said groove by at least an amount corresponding to said stroke, said row of guide holes and said elongated groove being parallel to each other, said row of guide holes and said elongated groove in said first front guide respectively facing said elongated groove and said row of guide holes in said second front guide;

a sliding member provided on said head frame in such a manner that said sliding member projects from both sides of said head frame and is slidable substantially parallel to the direction of movement of said printing head on said carriage;

a stationary member on said printer, said sliding member being displaced by abutting against said stationary member on said printer when said printing head is moved beyond a normal travel region;

transmission-changeover means provided between said sliding member and said front guide supporting frame for displacing said front guide supporting frame in response to displacement of said sliding member; and positioning means for stabilizing either said sliding member or said transmission lever selectively in a high-speed printing position and a high-quality printing position.

5. A wire-dot printer comprising:

a printing head for movement in a widthwise direction of a recording medium, said printing head including:

a hear frame having a nose portion;

a plurality of electromagnetically driven printing wires supported in alignment in the nose portion, said wires having front ends arranged in rows with the distance between said front ends in each row being the pitch;

a front guide supporting frame movably mounted on said nose portion for movement in a direction perpendicularly to said widthwise direction a stroke distance equal to substantially one-half of a pitch of the front ends of said printing wires;

means for changing the alignment of said wires between an arrangement for printing in a high-speed printing mode and an arrangement for printing in a high-quality printing mode, said means for changing the alignment comprising:

first and second front guide means for aligning front end portions of said printing wires in at least two rows, said first and second front guide means being provided on said nose portion so as to face each other in a direction in which said printing wires extend, said first front guide means being fixed to said nose portion, said second front guide means being fixed to said front guide supporting frame, and each of said first and second guide means having:

a plurality of guide holes for determining the position of the printing wires in each row; and an elongated groove through which a bundle of printing wires in each row extends, said groove having a length greater than the lengthwise dimension of said bundle of printing wires by an amount at least corresponding to said stroke;

said guide holes and said groove being provided substantially parallel to each other; and said guide holes and said elongated groove provided in said first front guide means facing said elongated groove and said guide holes, respectively, provided in said second front guide means;

a sliding member slidably mounted on said head frame for movement in a direction substantially parallel to said widthwise direction, said sliding member projecting from opposite sides of said head frame;

stationary means for displacing said sliding member when said sliding member abuts against said stationary member upon movement of said printing head beyond a normal travel region;

transmission changeover means for displacing said front guide supporting frame in response to said sliding member, said transmission changeover means being provided between said sliding member and said front guide supporting frame;

said transmission changeover means comprising a transmission lever which moves in response to displacement of said sliding member, a leaf spring having one end secured to said head frame and an opposite end engaged with said transmission lever, and engaging member means for engaging with an intermediate portion of said leaf spring to move said front guide supporting frame for movement in said first direction;

said sliding member including a cam, said transmission changeover means further including cam follower means for engaging with said cam, said cam including a cam groove having a first elongated changeover groove extending in said second direction, a second elongated changeover groove extending in said second direction and being offset from said first groove in a direction substantially perpendicular to said second direction, and an inclined groove that connects said first and second elongated changeover grooves, said cam follower means being dispersed within said cam groove, each of said first and second elongated changeover grooves including a projection therein.

6. A wire-dot printer having a printing head which is moved on a carriage in a widthwise direction of a recording medium and which has a plurality of electromagnetically driven printing wires which are supported in aligned form in a nose portion of a head frame and wherein a high-speed printing mode and a high-quality printing mode can be changed over from one to the other, said printer comprising:

first and second front guides provided on said nose portion in such a manner as to face each other in a direction in which bundles of said printing wires extend to align front end portions of said printing wires in at least two rows with the distance between said front end portions in each row being the pitch;

said first front guide being fixed to said nose portion, a front guide supporting frame provided on said nose portion, said second front guide being fixed to said front guide supporting frame, said front guide supporting frame being movable in a direction perpendicular to the direction of movement of the printing head on the carriage, said front guide supporting frame being movable with a stroke substantially equal to half a pitch of the front ends of said rows of printing wires;

said first and second front guides each having a plurality of guide holes in at least one row that determine the positions of said printing wires in said at least one row, and at least one elongated groove through which the bundle of printing wires in each row extends and which is longer than the length of said bundle of printing wires in said groove by at least an amount corresponding to said stroke, said row of guide holes and said elongated groove being provided in parallel to each other, said row of guide holes and said elongated groove in said first front guide respectively facing said elongated groove and said row of guide holes in said second front guide; and drive means for moving said front guide supporting frame in said direction perpendicular to the direction of movement of the printing head on said carriage.

7. A wire-dot printer according to claim 6 wherein said drive means comprises:

a sliding member provided on said head frame in such a manner that said sliding member projects from both sides of said head frame and is slidable substantially parallel to the direction of movement of said printing head on said carriage;

a stationary member on said printer, said sliding member being displaced by abutting against said stationary member on said printer when said printing head is moved beyond a normal travel region; and transmission-changeover means provided between said sliding member and said front guide supporting frame for displacing said front guide supporting frame in response to displacement of said sliding member.

8. A wire-dot printer according to claim 7, wherein said stationary member is a side plate of a printer frame or an abutting member that is secured thereto.

9. A wire-dot printer according to claim 7, wherein said transmission-changeover means includes at least one transmission lever which slides or pivots in response to the displacement of said sliding member, a leaf spring which is secured at one end thereof to said head frame and engaged at the other end thereof with said transmission lever, and an engaging member which moves together with said front guide supporting frame as one unit and which engages with an intermediate portion of said leaf spring.

10. A wire-dot printer according to claim 9, wherein said transmission lever is a member which slides in a direction substantially perpendicular to a direction of movement of said sliding member and which has a cam follower that engages with cam means provided on said sliding member.

11. A wire-dot printer according to claim 9, further comprising positioning means for stabilizing either said sliding member or said transmission lever selectively in a high-speed printing position and a high-quality printing position.

12. A wire-dot printer according to claim 11, wherein said positioning means includes a click projection or a click recess provided on said sliding member, and a positioning leaf spring which is provided on said head frame or a member that is in fixed relation to said head frame, and which engages with said projection or said recess.

13. A wire-dot printer according to claim 11, wherein said positioning means includes biasing means that biases said sliding member toward a central position by spring force even when said sliding member is disposed in either of said high-speed and high-quality printing positions.

14. A wire-dot printer according to claim 13, wherein said biasing means is a single compressed coil spring; said sliding member is formed with an engaging groove in which said coil spring is loaded, and a pair of relatively narrow continuous grooves which extend from both ends of said engaging groove in the direction of movement of said sliding member; and said head frame or a member which is in fixed relation to said head frame is provided with engaging members which are disposed in said continuous grooves, respectively, at a predetermined spacing.

15. A wire-dot printer comprising:

a printing head for movement in a widthwise direction of a recording medium, said printing head comprising:

a head frame having a nose portion;

a plurality of electromagnetically driven printing wires supported in alignment in a first direction in the nose portion, said wires having front ends arranged in rows with the distance between said front ends in each row being the pitch;

a front guide supporting frame movably mounted on said nose portion for movement in a stroke direction with a stroke at least as great as one-half of the pitch of the front ends of said printing wires;

means for changing the alignment of said wires between an arrangement for printing in a high-speed printing mode and an arrangement for printing in a high-quality printing mode, said means for changing the alignment comprising:

first and second front guide means for aligning front end portions of said printing wires in at least two rows, said first and second front guide means being provided on said nose portion so as to face each other in a direction in which said printing wires extend, said first front guide means being fixed to said nose portion, said second front guide means being fixed to said front guide supporting frame;

a plurality of guide holes in each of said first and second front guide means for determining longitudinal positions of the printing wires in each row;

an elongated groove in each of said first and second front guide means through which a bundle of printing wires in each row extends, said groove in said second front guide means having a length greater than the lengthwise dimension of said bundle of printing wires in said groove by an amount an least corresponding to said stroke;

said guide holes and said groove being provided substantially parallel to each other;

said guide holes and said elongated groove in said first front guide means facing said elongated groove and said guide holes, respectively, in said second front guide means; and drive means for moving said front guide support frame in said stroke direction.

16. A wire-dot printer according to claim 15, wherein said drive means comprises:

a sliding member slidably mounted on said head frame for movement in a direction substantially parallel to said direction of movement of said printing head, said sliding member projecting from opposite sides of said head frame;

stationary means for displacing said sliding member when said sliding member abuts against said stationary member upon movement of said printing head beyond a normal travel region; and transmission changeover means for displacing said front guide supporting frame in response to said sliding member, said transmission changeover means being provided between side sliding member and said front guide supporting frame.

17. A wire-dot printer according to claim 16, wherein said printer includes a printer frame having a side plate, and said stationary member includes an abutting member secured to the side plate of the printer frame.

18. A wire-dot printer according to claim 16, wherein said printer includes a printer frame, and said stationary member includes a side plate of the printer frame.

19. A wire-dot printer according to claim 16, wherein said transmission changeover means comprises:

a transmission lever which moves in response to displacement of said sliding member, a leaf spring having one end secured to said head frame and an opposite end engaged with said transmission lever, and engaging member means for engaging with an intermediate portion of said leaf spring to move said front guide supporting frame for movement in said first direction.

20. A wire-dot printer according to claim 19, wherein said sliding member is pivotally connected with said transmission lever.

21. A wire-dot printer according to claim 19, wherein said transmission changeover means further includes linkage means for connecting said sliding member with said transmission lever.

22. A wire-dot printer according to claim 19, wherein said transmission lever is mounted for slidable movement in a direction substantially perpendicular to said second direction.

23. A wire-dot printer according to claim 19, wherein said sliding member includes a cam, and said transmission changeover means further includes cam follower means for engaging with said cam.

24. A wire-dot printer according to claim 23, wherein:

said cam includes a cam groove having:

a first elongated changeover groove extending in said second direction, a second elongated changeover groove extending in said second direction and being offset from said first groove in a direction substantially perpendicular to said second direction, and an inclined groove that connects said first and second elongated changeover grooves, and said cam follower means is fit within said cam groove.

25. A wire-dot printer according to claim 19, further comprising positioning means for selectively stabilizing one of said sliding member and said transmission lever in said high-speed printing mode and said high-quality printing mode.

26. A wire-dot printer according to claim 16, wherein said positioning means includes:

one of a click projection and click recess providing in said sliding member, and positioning leaf spring means for engaging with said one of said click projection and said click recess, said positioning leaf spring means being fixed with respect to said head frame.

27. A wire-dot printer according to claim 25, wherein said positioning means includes biasing means for biasing said sliding member toward a central position, when said sliding member is positioned during the high-speed printing mode and when said sliding member is positioned during the high-quality printing mode.

28. A wire-dot printer according to claim 27, wherein said sliding member includes an engaging groove extending in said second direction and having a first width, a first continuous groove having a width narrower than said engaging groove and extending from one end of said engaging groove and a second continuous groove having a width narrower than said engaging groove and extending from an opposite end of said engaging groove, wherein said biasing means includes a single compressed coil spring load into said engaging groove, and further including a first engaging member provided in said first continuous groove and a second engaging member provided in said second continuous groove, said first and second engaging members being fixed with respect to said head frame.

29. A printing head for a wire-dot printer comprising:

a head frame having a nose portion;

a plurality of electromagnetically driven printing wires supported in said nose portion;

a guide supporting frame movably mounted on said nose portion for movement in a stroke direction;

first and second guide means aligning front end portions of at least two groups of said printing wires in at least two rows, said first guide means being disposed behind said second guide means such that said second guide means is closer to said front end portion of said printing wires than said first guide means, said first guide means being fixed to said nose portion, said second guide means being fixed to said front guide supporting frame;

a plurality of guide holes in each of said first and second guide means for determining longitudinal positions of the printing wires in each row;

an elongated groove in each of said first and second guide means through which a group of printing wires in each row extend;

said guide holes and said elongated groove in said first guide means facing said elongated groove and said guide holes, respectively, in said second guide means such that one group of printing wires in one row pass through the groove in said first guide means and thence through said guide holes in said second guide means while another group of printing wires in another row pass through the guide holes in said first guide means and thence through the groove in said second guide means; and drive means for moving said guide supporting frame in said stroke direction to thereby change the position of the front end portions of said printing wires in said one row relative to the position of the front end portions of the printing wires in said other row.

* * * * *